US007318270B1

(12) United States Patent
O'Loughlin

(10) Patent No.: US 7,318,270 B1
(45) Date of Patent: Jan. 15, 2008

(54) METHOD FOR PRODUCING A FULL WAVE BRIDGE RECTIFIER SUITABLE FOR LOW-VOLTAGE, HIGH-CURRENT OPERATION

(75) Inventor: James P. O'Loughlin, Placitas, NM (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 51 days.

(21) Appl. No.: 11/106,407

(22) Filed: Apr. 14, 2005

(51) Int. Cl.
*H01F 7/06* (2006.01)
*H01F 27/08* (2006.01)
*B65H 18/28* (2006.01)

(52) U.S. Cl. ..... 29/605; 29/602.1; 29/606; 336/180; 242/166

(58) Field of Classification Search ..... 29/602.1, 29/605, 606; 336/180, 147, 150, 170, 183, 336/223; 242/166, 174, 160.1, 170
See application file for complete search history.

(56) References Cited

U.S. PATENT DOCUMENTS 3,745,440 A * 7/1973 Lord ..... 363/17
5,579,202 A * 11/1996 Tolfsen et al. ..... 361/232
5,627,482 A * 5/1997 Lamatsch ..... 326/93
6,417,592 B2 * 7/2002 Nakamura et al. ..... 310/184

* cited by examiner

*Primary Examiner*—A. Dexter Tugbang
*Assistant Examiner*—Tai Van Nguyen
(74) *Attorney, Agent, or Firm*—Kenneth E. Callahan

(57) ABSTRACT

A method for producing center-tapped and non-center-tapped full wave bridge rectifiers suitable for low-voltage high-current operation by simultaneously winding a plurality of identical secondary coil sections around a primary coil using on a prearranged secondary foil conductor and insulation ensemble and equivalent circuit connections.

2 Claims, 6 Drawing Sheets

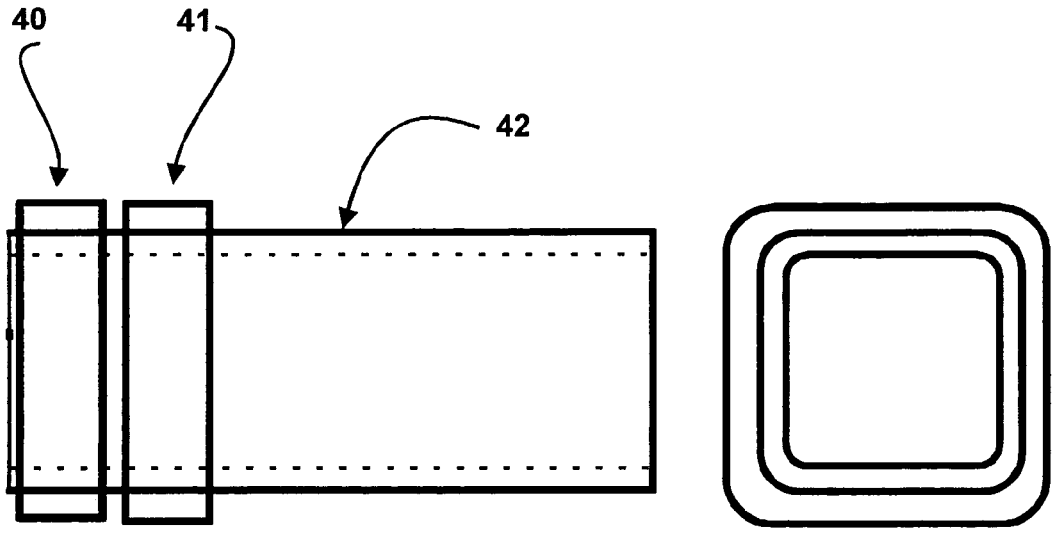
FIG. 7 (Prior Art)
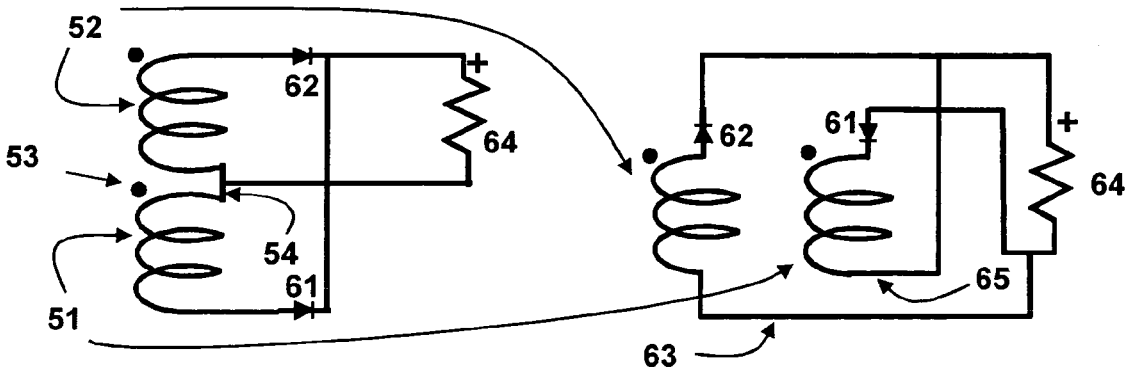
FIG. 8a (Prior Art)
FIG. 8b

METHOD FOR PRODUCING A FULL WAVE BRIDGE RECTIFIER SUITABLE FOR LOW-VOLTAGE, HIGH-CURRENT OPERATION

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

This invention relates to low-voltage, high-current inverter transformers, and more particularly relates to an improved winding configuration for such transformers.

High frequency switching circuits have been used to advantage in power conditioning apparatus for many decades. A major advantage comes from the fact that high-frequency transformers are much smaller, lighter, cheaper and more efficient than low-frequency units of the same power rating. In the particular range of applications involving rectified outputs at low voltage and high current, the efficiency of the rectifiers and rectifier circuit are also important considerations. The two commonest rectifier circuits are the full-wave bridge rectifier (FWBR) and the full wave circuit center-tapped rectifier (FWCTR), shown in FIGS. 1*a* and 1*b*, respectively.

The function of both circuits shown is to rectify the AC (alternating current) provided from the transformer, by means of the rectifiers or diodes, to DC (direct current) which is then delivered to the load. In the case of the bridge rectifier, the AC current from the transformer passes through two diodes in series in order to flow to the load. In the case of the center-tapped circuit the AC current from the transformer passes through only one diode to flow to the load. In either case, the peak and average current is the same. Given that the forward drop of each diode is the same, the power loss in the diodes as a whole in the bridge circuit is twice that of the center-tapped circuit. Typically, the forward drop of a diode is on the order of 1 to 2 volts. If the output voltage of the rectifier is low, this has a significant impact on the efficiency. The impact is much more for the bridge rectifier than for the center-tapped circuit. For example, if the output voltage is 5 volts and the diode drop is 1 volt, the rectifier efficiency for the bridge is 5/(5+2)=71%; and for the center-tapped circuit is 5/(5+1)=83%.

There are other differences between the two circuits. The peak inverse voltage rating of the diodes in the full wave center-tapped circuit must be about twice that of the diodes in the bridge circuit. However, there are only two diodes in the FWCTR opposed to four in the FWBR. The transformer winding for the FWBR is half the voltage rating of the center-tapped winding and has a better utilization factor. However, considering all factors, the center-tapped circuit is the better choice for low-voltage high-current applications. Another consideration is the fact that rectifiers or diodes for high frequency applications are limited in the available maximum current rating to a few tens of amperes. This requires the use of parallel rectifier circuits in high current applications. The parallel circuits must match closely in electrical characteristics to insure that current will share equally, hence the transformer secondary windings of each parallel circuit must be matched. The best way to accomplish this is to wind identical secondary sections ($S_y$) side-by-side over the primary ($P_y$) as shown in FIG. 2.

From the coil diagram in FIG. 2 it is obvious that manufacturing the several secondary windings is a complicated procedure in that the start leads must be routed up between each coil section. This requires that each section be individually wound. In addition, the procedure is more complicated if the secondary is center-tapped and each side of the winding from the center-tap is to be identical. The present invention discloses a new winding configuration and winding procedure that provides for the simultaneous winding of identical sections, either center-tapped on non-center-tapped in a single operation.

SUMMARY OF THE INVENTION

The present invention is an improved secondary winding technique using simplified coils with multiple secondaries for inverter transformers used in low-voltage high-current rectifier applications. High-frequency fast recovery rectifiers have limited maximum current ratings requiring parallel circuits for high-current high-frequency applications. To insure good current sharing, it is advantageous to use separate transformer windings for each rectifier set and each section must be as closely matched as possible. The coil design of this invention is applicable to both full-wave bridge rectifiers and full wave center-tapped rectifiers. It uses foil conductors and provides multiple parallel secondary windings for the purpose of controlling skin effect losses, improving the winding space factor, and improving heat transfer. In addition, the configuration provides matched and balanced coupling and leakage inductance for each secondary section. Coil designs are disclosed that are both simple and economical to manufacture.

BRIEF DESCRIPTION OF THE DRAWINGS

FIG. 7 is a diagram of a single secondary section of side-by-side halves of a center-tapped secondary as wound over the primary in side and cross-sectional views.

FIG. 8*a* is a FWCTR circuit.

FIG. 8*b* is the electrical equivalent circuit shown in FIG. 8*a* formed by different interconnections of the components.

DESCRIPTION OF THE PREFERRED EMBODIMENT

High-frequency high-current windings require consideration of the skin effect. This is the well-known behavior of current distribution in a conductor at high frequency. With increasing frequency the depth of current penetration into a conductor diminishes, this depth is know as the skin depth and is given approximately, for copper, by:

$$\delta = \frac{6.61}{\sqrt{f}} \tag{1}$$

Where:

δ is skin depth in cm f=frequency in Hertz

The most detrimental effect is the increase in apparent resistance and corresponding loss. This is conventionally dealt with by the use of Litz wire or thin foil conductors. These approaches work because the dimensions of the Litz wire individual conductors or the thickness of the foil are selected to be less then or comparable to current skin depth. Thus the current distribution within the conductor is approximately uniform and the apparent resistivity is not significantly increased above the DC value. Litz wire has a much lower space factor than foil because it consists of woven bundles of fine wire. High power inverters usually operate at a frequency less than 100 kHz. The skin depth at 100 kHz is about 0.2 mm or 0.008 inches. This is a reasonable foil thickness and when used with 0.002 inch layer insulation and results in a space factor of about 80%. The comparable space factor for Litz wire is typically less than about 40%. The use of Litz wire will result in a larger winding size because of the lower space factor and will also have a lower thermal conduction that complicates the heat transfer and maximum operating temperature limitation. The use of foil is advantageous for these reasons and is also instrumental in the implementation of the present invention, as will become apparent in the subsequent discussion.

Figure 3:
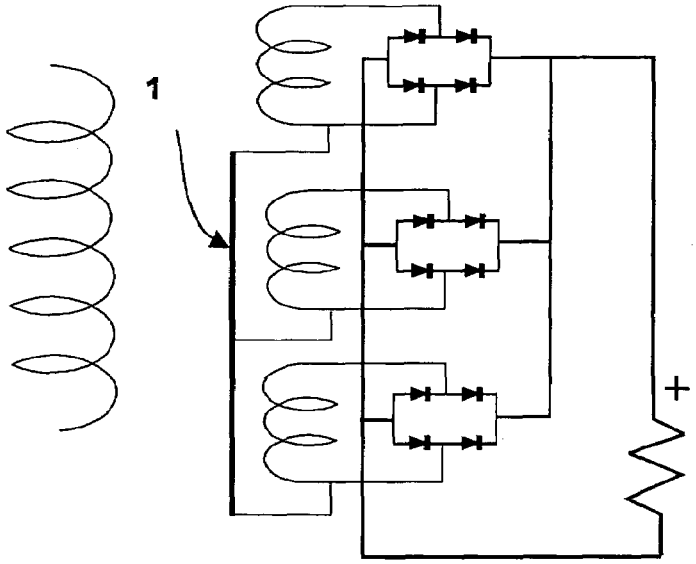
FIG. 3 (Prior Art)
FIG. 3 is a schematic diagram of a three secondary group connected in common at the low end, each secondary feeding a FWBR, and the FWBR's connected in parallel and then to the load.

There are two implementations of the invention, the simpler for non-center-tapped windings and a more involved for center-tapped windings. The non-center-tapped embodiment will be considered first. The non-center-tapped winding is compatible with the FWBR. The FWBR connects between the two leads of each winding section. It is permissible to have one side of each winding common to all other corresponding sides of the other windings as shown schematically by 1 in FIG. 3. FIG. 3 is a schematic diagram showing three secondary groups connected in common at the low end, each secondary group feeding a FWBR, and the FWBR's connected in parallel and then to the load.

Figure 1A:
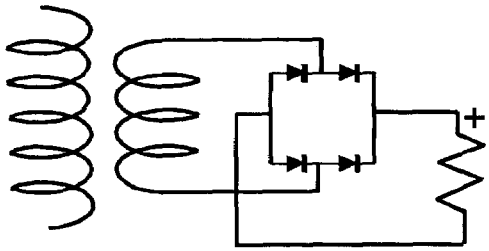
FIG. 1a (Prior Art)
FIG. 1*a* shows a typical full wave bridge rectifier circuit diagram.
Figure 1B:
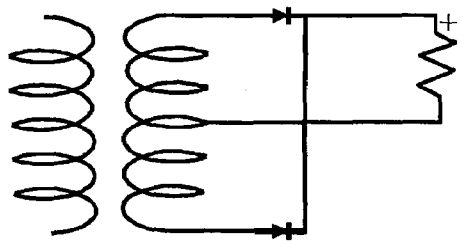
FIG. 1b (Prior Art)
FIG. 1*b* shows a typical full wave center-tapped rectifier circuit diagram.
Figure 2:
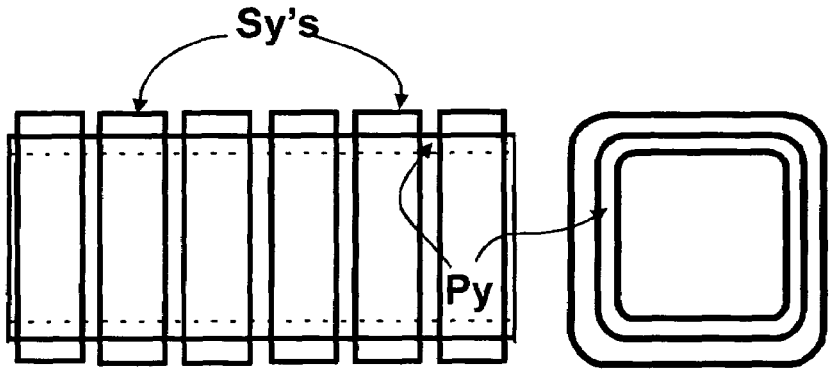
FIG. 2 (Prior Art)
FIG. 2 depicts a transformer coil with multiple side-by-side identical secondary windings in side and cross-sectional views.

Connecting one end of each winding, as shown in FIG. 3 is permitted but is not required as an electrical design feature. However, by making this connection, it provides a basis for the present invention in terms of the simplicity of fabrication and manufacture of the transformer secondary winding ensemble. FIG. 2 shows the primary as wound from a foil that is the full width of the coil, each turn being on top of the previous turn until the required total number of turns has been accomplished. The lead connections to the primary are accomplished by tabs (not shown in FIG. 2) that are perpendicular to the turns, one each at the start and finish. The secondary windings are wound in parallel sections on top of the primary winding. Such a transformer secondary ensemble would be conventionally wound as individual sections, one at a time with tap leads being connected at the start and finish turns. The start tab lead would be routed up the side of the winding so as to be accessible for connection to the external circuit. The finish tab is inherently accessible, being on the top of the winding. At this point we observe from FIG. 3 that if we use the otherwise unnecessary interconnection between the start ends of the several secondary windings, it is possible to pre-construct an arrangement of winding and insulation, such that when it is wound it will accomplish the entire secondary winding ensemble in a single winding operation.

Figure 4:
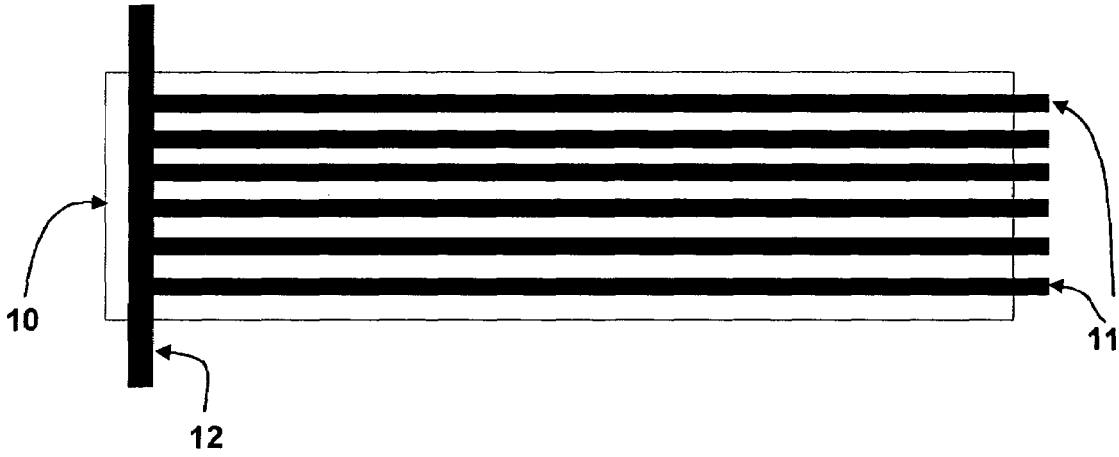
FIG. 4 shows a pre-arrangement of conductors and insulation of a six secondary winding ensemble for use in a FWBR application.
Figure 5:
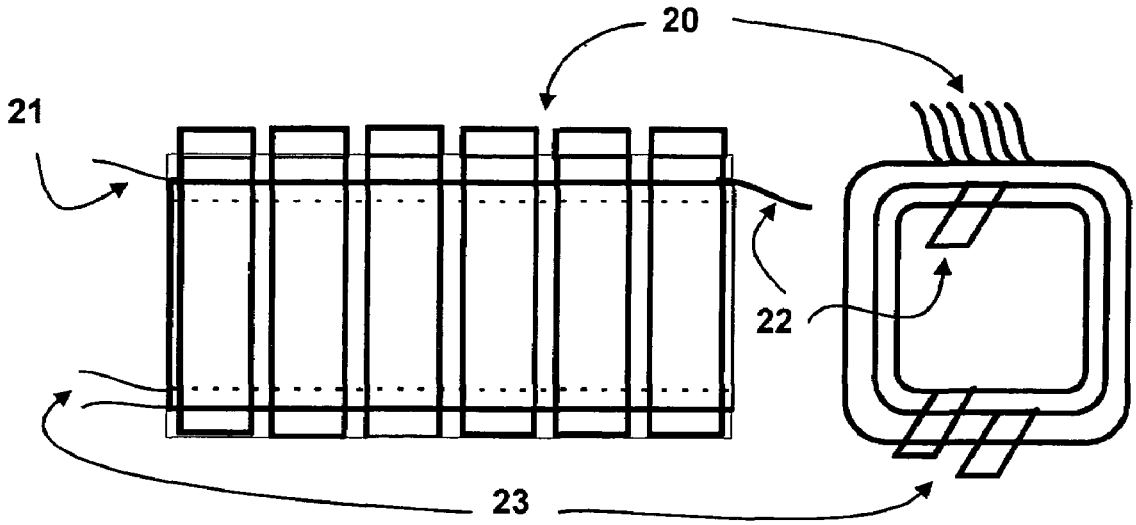
FIG. 5 is a diagram of a completed coil wound with the secondary ensemble of FIG. 4 shown in side and cross-sectional views.

The manner of implementing this pre-construction arrangement is illustrated in FIG. 4. The materials are prepared by first laying out the insulation 10. This insulation will become the layer insulation when the ensemble is wound. The individual foil conductors 11 of each section are arranged as shown on the insulation 10 and connected at the left (start) end to the cross-connection tab 12. FIG. 4 shows an arrangement of six secondary sections. It is obvious that the same type of arrangement can be implemented for any number of sections. The right (finish) ends of the section conductors 11 are extended to ultimately become the finish terminal or tabs of each section. The cross-connection 12 is extended beyond the insulation 10 to ultimately become tab terminals for the start ends of all of the sections 11. The cross-connection 12 is shown as 1 in relation to the schematic in FIG. 3. FIG. 5 shows the completed coil as wound with the ensemble of FIG. 4. The finish end tabs 20 of the secondary sections are shown on the top side of the coil. The start tabs 21 and 22 are shown extending from the ends of the coil on the topside. The primary winding tab terminals 23 are shown extending from the bottom end of the coil.

Figure 6:
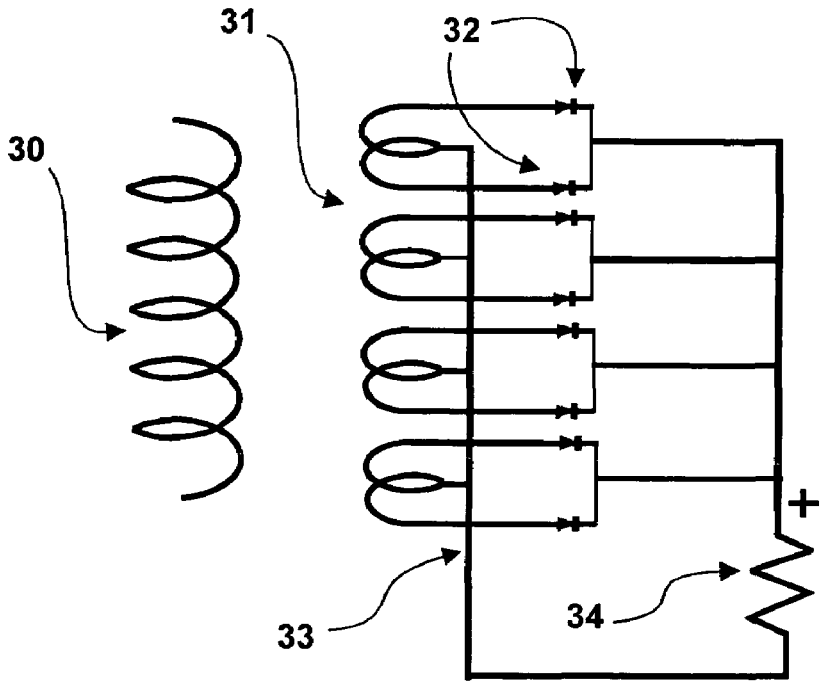
FIG. 6 (Prior Art)
FIG. 6 shows a circuit schematic of a four secondary, center-tapped configuration.

Next consider the implementation of the present invention with respect to center-tapped windings. The circuit schematic of a typical four secondary center-tapped configuration is shown in FIG. 6. The circuit consists of a primary 30, coupled to four secondary center-tapped windings 31. Each secondary has a pair of diodes/rectifiers 32, one connected to each end of the winding. A conductor 33 connects all of the secondary center-taps to the negative or return side of the load 34. All of the diode/rectifier 32 cathodes are connected in common and to the positive side of the load 34. It is desirable to have each half of the center-tapped secondary winding be as electrically identical as possible to insure balanced circuit impedance and equal currents in each side. This can be accomplished if each half of a center-tapped secondary is implemented, as shown in FIG. 7 as a side-by-side pair of identical windings 40 and 41, wound over the primary 42.

The phasing or polarity of this pair of windings must be properly maintained when connected to the diodes and circuit. The direction of rotation of the winding of the section determines the polarity. That is, if both sections of the side-by-side windings as shown in FIG. 7 are wound with the start lead proximate to the primary, then the finish ends, 40 and 41 will have the same polarity. In order to properly connect this winding pair with the correct polarity for a center-tapped rectifier, the start lead of section 40 must be connected to the finish lead 41 which forms the center-tap of the full secondary section. This requires that a connection be made from the start of the first winding 40, up the space between the first 40 and next winding 41 and thence to the finish of the next winding 41. To compete the circuit connection, the finish of the first winding 40 is connected to the anode of one diode (not shown) and the start of the next winding 41 to the anode of the other diode (not shown), in keeping with the circuit as indicated in FIG. 6.

Another possibility is to reverse wind the second half of the secondary 41 in FIG. 7. This will reverse the polarity such that the start leads of the first winding 40 and the next winding 41 need be connected to form the center tap and the finish leads of the first winding 40 and the next winding 41 will each connect to the anode of a rectifier.

Both of these two options will accomplish the proper circuit function; however, the winding process is complicated by the inter connections and/or the need to reverse wind. The result is that each section must be individually wound and interconnected in the process, making the winding task laborious, inconvenient and, expensive.

It is an objective of the present invention to disclose a procedure that both accomplishes the electrical requirements and simplifies the winding procedure such that only a single winding operation is required given proper preparation of the materials. To this end consider the diagrams in FIG. 8*a* and FIG. 8*b*. The left (8*a*) and right (8*b*) circuits are electrically equivalent and are configured using the same two coils (51 and 52) wound side-by-side with the same rotation. The polarity dots, e.g. 53, represent the finish ends of the windings. The center-tap connection in the left circuit (8*a*) is formed by connecting the finish of a first coil 51 to the start of the second coil 52 with the conductor 54. As previously explained, implementation of this connection 54 requires winding each section of the coils 51 and 52 one at a time.

The right circuit (FIG. 8*b*) represents a configuration that is consistent with the electrical requirements and the objective of the present invention to simplify the winding process to a single operation. In this configuration the cathode of a first diode 61 is connected to the finish of winding of a first coil 51. A tab lead 65 connects the start of the first coil 51 to the cathode of the second diode 62 and positive side of the load 64. Tab lead 63 connects the start of the second coil 52 to the negative or return side of the load 64 and to the anode of the first diode 61. This implementation requires the use of two tab lead cross-connections instead of a singe tab lead as in the implementation for use with a FWBR. This equivalent circuit is called a two tab lead cross-connection FWCTR equivalent circuit.

Figure 9:
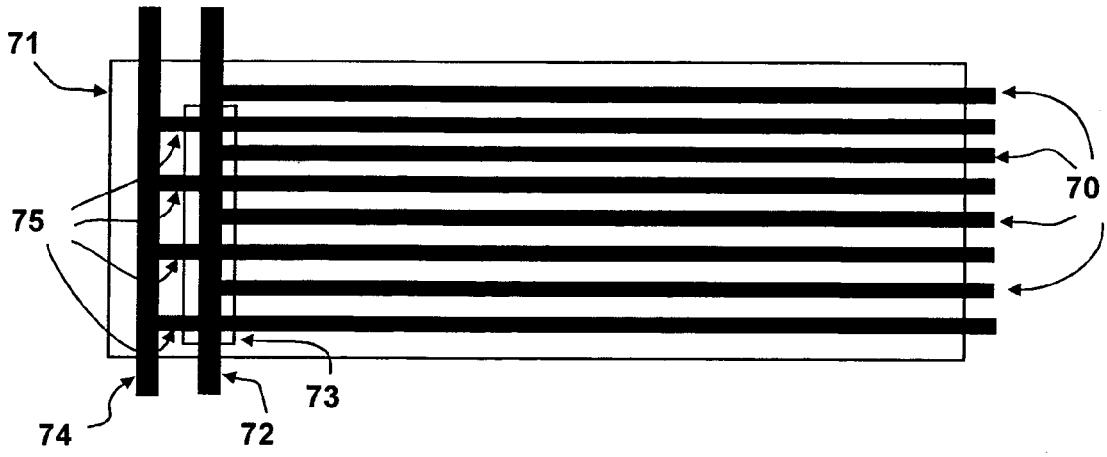
FIG. 9 shows the pre-arrangement of conductors and insulation of a four secondary center-tapped winding ensemble according to the invention for use in a FWCTR application.

The pre-arrangement of the conductors and insulation for the center-tapped winding implementation of the invention is shown in FIG. 9 for an ensemble of four center-tapped secondary windings. The diagram in FIG. 9 shows the arrangement of the conductors and insulations to accomplish the winding of a four secondary center-tapped transformer in a single winding operation. In FIG. 9 there are two groups of four conductors each, Group A and Group B, which are interleaved and insulated from each other. Group A form the right set of coil halves and Group B the left set. The sequence of preparation consists of positioning the conductors 70 for the right (Group A) set of coil halves on the layer insulation sheet 71. Next, the start lead tab 72 for the Group A set of coil halves 70 is positioned and connected to the start end of the right coil half conductors 70. An insulation strip 73 is next positioned over the start lead tab 72 of the right half coil. This insulation strip 73 is necessary to insulate the start lead tab 74 of the left side coil halves from the start lead tab 72 of the right coil halves (shown in FIG. 9 as offset). Next the left coil conductors 75 and the left tab lead 74 are positioned and connected. This completes the pre-winding arrangement of the materials. The resulting completed coil, using the prearranged materials of FIG. 9 is shown in FIG. 10.

Figure 10:
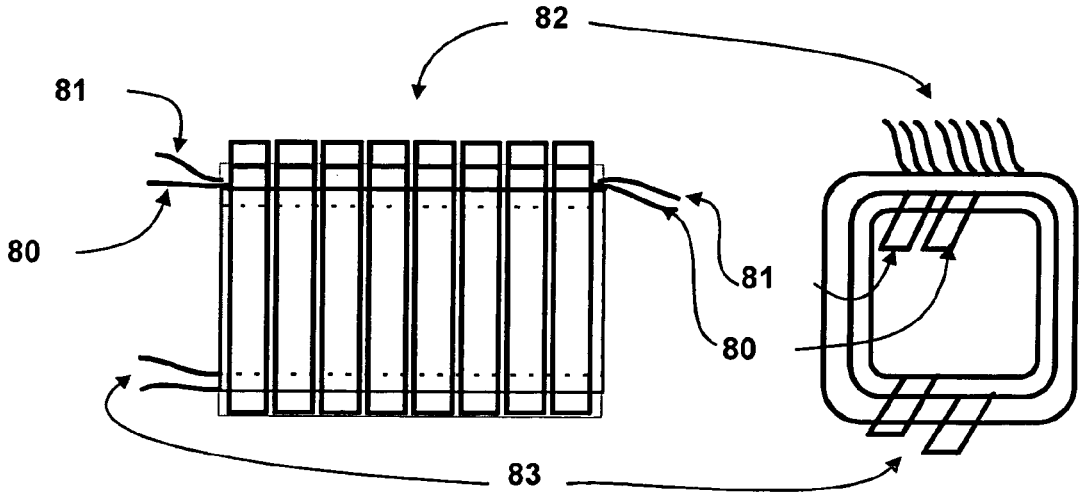
FIG. 10 shows the finished coil of the four secondary center-tapped transformers using the pre-arranged materials shown in FIG. 9 in side and cross-sectional views.

The tab lead 80 in FIG. 10 is connected to the start ends of the left coils and the tab lead 81 is connected to the start ends of right coils. The finish ends of all coils 82 are on the topside of the finished coil. The primary tab leads 83 are brought out on the bottom side of the finished coil. The finished coil can be assembled to a core to complete the transformer and then connected into a FWCTR circuit as shown in FIG. 6.

The major advantage of the invention is the winding method that provides a simple, economic means for producing a multi-secondary transformer with superior electrical performance and suitable for either FWBR or FWCTR applications. In addition the use of foil windings improves the space factor and reduces the over-all size of the transformer. Further, the foil winding, having a superior space factor, also has a superior thermal conductivity and therefore an improved heat transfer capability. This results in a cooler running unit or equivalently a higher power rating for the same maximum operating temperature.

Figure 11:
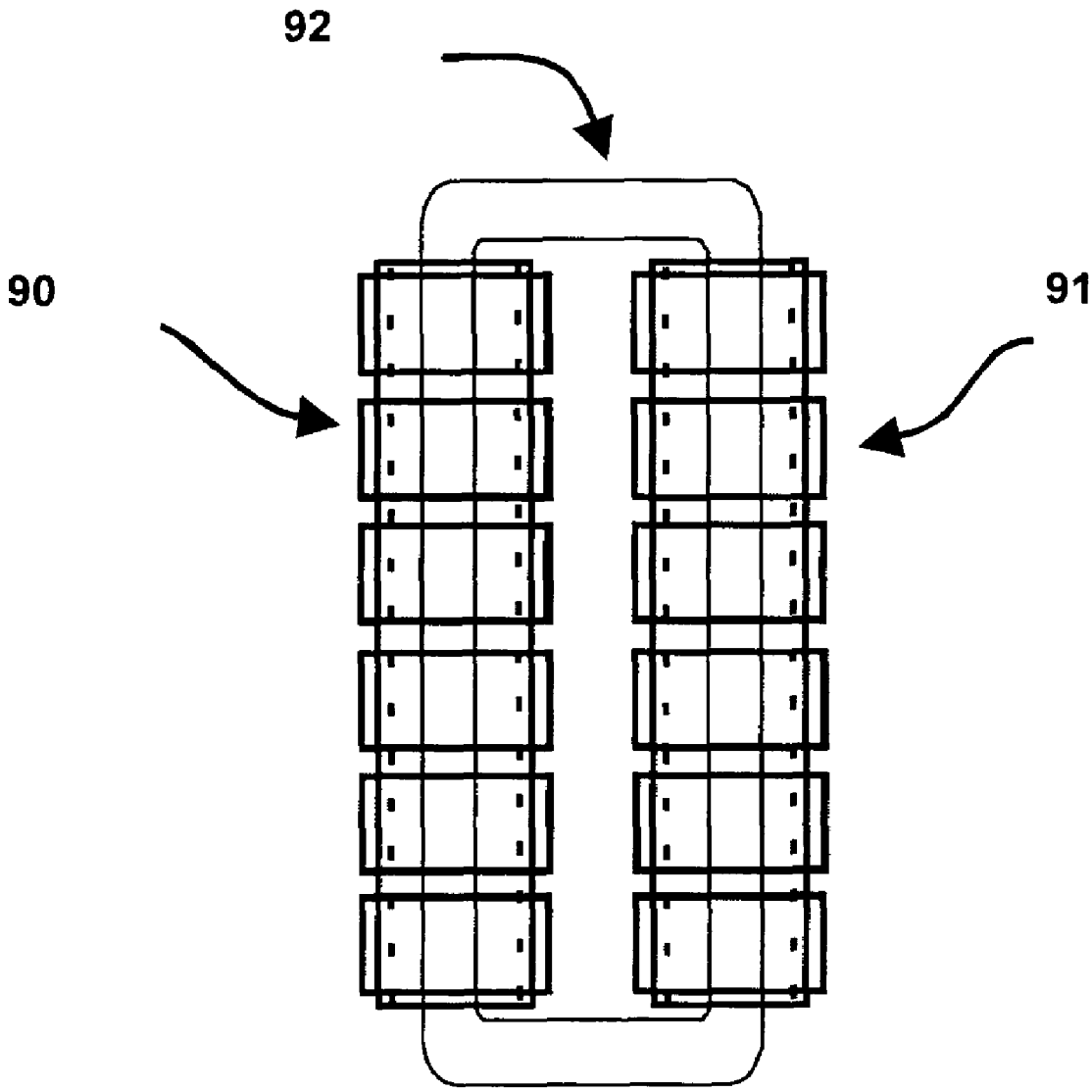
FIG. 11 shows an alternative implementation using two coil structures, one on each leg of the single loop core.

Two alternative implementations of the invention have been presented: the implementation for single winding sections for FWBR applications and the side-by-side coil pairs for FWCTR applications. These implementations were based on a single coil structure per transformer. Alternatively, two coil structures 90, 91 per transformer can be used, one on each leg of a single loop core 92 as indicated in FIG. 11. The invention may also be applied to multiple coils of poly-phase transformers in a manner obvious to those skilled in the art.

The scope of the invention includes all modification, design variations, combinations, and equivalents that would be apparent to persons skilled in the art, and the preceding description of the invention and its preferred embodiments is not to be construed as exclusive of such.

The invention claimed is:

1. A method for producing a full wave bridge rectifier suitable for low-voltage, high-current operation by simultaneously winding a plurality of essentially identical secondary coil sections around a primary coil, the method comprising:

winding a primary coil of a given diameter comprised of a thin foil conductor having a width sufficient to encompass the subsequently wound plurality of secondary coil sections side-by-side;

preparing a secondary winding ensemble having a plurality of secondary coil sections by laying out a sheet of insulation approximately the width of said primary coil and of a length determined by the diameter of said primary coil and by the number of turns of said ensemble about said primary coil, laying out a plurality of foil conductors parallel to each other and insulated from each other on said insulation sheet, each foil conductor having a start end and a finish end with said start ends being electrically connected by a cross-connection tab, said tab being extended beyond said insulation sheet to thereby form a tab terminal for the start ends of all of the secondary coil sections and said finish ends extending beyond said insulation sheet to become the finish tabs of each secondary coil section; and winding said secondary winding ensemble a predetermined number of times around said primary coil.

2. A method for producing a center-tapped, full wave bridge rectifier suitable for low-voltage, high-current operation by simultaneously winding a plurality of essentially identical secondary coil sections around a primary coil, the method comprising:

winding a primary coil of a given diameter comprised of a thin foil conductor having a width sufficient to encompass the subsequently wound plurality of secondary coil sections side-by-side;

preparing a secondary winding ensemble having a plurality of secondary coil sections on a left side of said center tap and on a right side of said center tap by laying out a first sheet of insulation approximately the width of said primary coil and of a length determined by the diameter of said primary coil and the number of turns of said ensemble about said primary coil, laying out a plurality of right secondary coil foil conductors parallel to each other and insulated from each other on said first sheet of insulation for a right set of coil halves, each right secondary coil foil conductor having a start end and a finish end with said start ends being electrically connected by a right cross-connection tab that is extended beyond said insulation sheet to become a right tab terminal for the start ends of all of the right secondary coil sections and said finish ends extending beyond said first insulation sheet to become the right finish tabs of each right secondary coil section, laying a second insulation sheet over the right cross-connection tab, laying out a plurality of left secondary coil foil conductors interleaved with said right secondary coil foil conductors on said first insulation sheet and extending on top of said second insulation sheet, each left foil conductor having a start end and a finish end with said start ends being electrically connected by a left cross-connection tab that is extended beyond said insulation sheet to become a left tab terminal for the start ends of all of the left secondary coil sections and said finish ends extending beyond said first insulation sheet to become the left finish tabs of each left secondary coil section;

winding said secondary winding ensemble a predetermined number of times around said primary coil; and connecting said left and right cross-connection tab leads and said finish ends according to a two tab lead cross-connection FWCTR equivalent circuit.

* * * * *